US007451855B2

(12) United States Patent
Wang

(10) Patent No.: US 7,451,855 B2
(45) Date of Patent: Nov. 18, 2008

(54) ACOUSTIC ABSORBING DEVICE

(76) Inventor: Samw Hong Jen Wang, No. 14-3, Fusing 1st Road, Singsing District, Kaohsiung 80053 (TW)

( * ) Notice: Subject to any disclaimer, the term of this patent is extended or adjusted under 35 U.S.C. 154(b) by 0 days.

(21) Appl. No.: 11/651,210

(22) Filed: Jan. 9, 2007

(65) Prior Publication Data

US 2008/0164090 A1 Jul. 10, 2008

(51) Int. Cl.
*E04B 1/82* (2006.01)

(52) U.S. Cl. ..... 181/286; 181/198; 181/210; 181/284; 181/288; 181/292; 181/293; 52/144; 52/145

(58) Field of Classification Search ..... 181/198, 181/210, 284, 286, 288, 292, 293; 52/144, 52/145

See application file for complete search history.

(56) References Cited

U.S. PATENT DOCUMENTS 1,358,883 A * 11/1920 Seabrook ..... 181/192
2,385,814 A * 10/1945 Kamrath ..... 96/383
2,840,179 A * 6/1958 Junger ..... 181/286
2,857,945 A * 10/1958 Brundell et al. ..... 144/208.8
2,887,173 A * 5/1959 Boschi ..... 181/286
3,103,255 A * 9/1963 Boschi et al. ..... 181/293
3,159,090 A * 12/1964 Schutt ..... 454/270
3,846,949 A * 11/1974 Okawa ..... 52/438
3,983,956 A * 10/1976 Manhart ..... 181/210
4,137,992 A * 2/1979 Herman ..... 181/213
4,433,751 A * 2/1984 Bonneau ..... 181/213
4,947,958 A * 8/1990 Snyder ..... 181/296
5,004,070 A * 4/1991 Wang ..... 181/286
5,185,504 A * 2/1993 Jen ..... 181/286
5,329,073 A * 7/1994 Shono et al. ..... 181/210
5,393,940 A * 2/1995 Bedard et al. ..... 181/210
5,491,310 A * 2/1996 Jen ..... 181/286
5,579,398 A * 11/1996 Ewens ..... 381/338
5,670,758 A * 9/1997 Borchers et al. ..... 181/286
5,760,349 A * 6/1998 Borchers et al. ..... 181/286
5,859,393 A * 1/1999 Cummins et al. ..... 181/257
5,962,823 A * 10/1999 Asahara et al. ..... 181/286
5,997,985 A * 12/1999 Clarke et al. ..... 428/116
6,343,672 B1 * 2/2002 Petela et al. ..... 181/224
6,457,554 B1 * 10/2002 Wang ..... 181/282
6,755,280 B2 * 6/2004 Porte et al. ..... 181/290
7,124,856 B2 * 10/2006 Kempton et al. ..... 181/284
7,314,113 B2 * 1/2008 Doll ..... 181/225
2003/0150671 A1 * 8/2003 Kerr ..... 181/264
2003/0214055 A1 * 11/2003 Yazici et al. ..... 261/109
2005/0157901 A1 * 7/2005 Hatano et al. ..... 381/356
2006/0054380 A1 * 3/2006 Doll ..... 181/225

* cited by examiner

*Primary Examiner*—Lincoln Donovan
*Assistant Examiner*—Christina Russell
(74) *Attorney, Agent, or Firm*—Charles E. Baxley

(57) ABSTRACT

An acoustic absorbing device includes a housing having a chamber formed by an outer peripheral wall and a bottom wall, a hood engaged into the housing, an absorbing member engaged into the hood, and a silencer engaged into the absorbing member, the silencer and the absorbing member may be selectively attached to the hood or may be easily replaced with the other ones or new or different ones according to different environment. The silencer may include an outer cap extended into or out of the absorbing member. The housing includes one or more couplers for selectively coupling the housing to the other coupling or supporting members.

20 Claims, 5 Drawing Sheets

ACOUSTIC ABSORBING DEVICE

BACKGROUND OF THE INVENTION

1. Field of the Invention

The present invention relates to an acoustic absorbing device, and more particularly to an acoustic absorbing device including an improved structure for effectively absorbing sounds or noises and for allowing the acoustic absorbing device to be easily and quickly secured or attached to various support members or devices.

2. Description of the Prior Art

Typical acoustic absorbing devices have been developed and disposed on the side portions of the roadways, bridges, etc. for absorbing the sounds or noises and for preventing the sounds or noises from annoying the residents located near the roadways, the bridges, or the like.

For example, U.S. Pat. No. 3,846,949 to Okawa discloses one of the typical sound insulating blocks comprising a specially shaped or configured sound absorbing plate fixed inside a cover which is then tightly closed in a block for sound or noise absorbing purposes, for allowing the typical sound insulating blocks to be stacked together to form a sound insulating wall.

However, the typical sound insulating blocks may not be easily attached to the other supporting members in the house buildings and thus may not be used for suitably absorbing the sounds or noises in the house buildings.

U.S. Pat. No. 5,491,310 to Jen who is the present inventor and applicant discloses another typical acoustic board comprising a perforated front silencer disposed within a conical hood which is then disposed or engaged within an outer housing, and a cover threadedly engaged with the large end of the conical hood, and a rear silencer provided in the small end of the conical hood for isolating the noise.

However, the typical acoustic board comprising an outer cover disposed and engaged with the outer portion of the conical hood such that the entering of the sounds or noises into the conical hood will be limited and such that the sound or noise absorbing or isolating effect may be greatly decreased.

U.S. Pat. No. 6,457,554 to Wang who is also the present inventor and applicant discloses a further typical acoustic absorber for absorbing noises in buildings and also comprising a perforated and specially shaped or configured sound or acoustic absorbing member fixed inside an enclosure, and including a perforated circular protrusion provided on a front portion of a casing and extended out of the enclosure, and including an opened front entrance for allowing the sound or noise to easily enter into the enclosure.

However, the specially shaped or configured sound or acoustic absorbing member of the typical acoustic absorber includes a predetermined shape or configure that may not be changed to the other shape or structure according to the requirement of the environment such that the sound or noise absorbing or isolating effect will be limited.

The present invention has arisen to mitigate and/or obviate the afore-described disadvantages of the conventional acoustic absorbing devices.

SUMMARY OF THE INVENTION

The primary objective of the present invention is to provide an acoustic absorbing device including an improved structure for effectively absorbing sounds or noises and for allowing the acoustic absorbing device to be easily and quickly secured or attached to various support members or devices.

In accordance with one aspect of the invention, there is provided an acoustic absorbing device comprising a housing including a chamber formed therein, and including an outer peripheral wall and a bottom wall for forming the chamber of the housing, and including an outer opening end, a hood engaged into the chamber of the housing and including a number of orifices formed therein for allowing a sound to transmit through the hood and into the housing, an absorbing member engaged into the hood and attached to the hood and including a first gap formed between the hood and the absorbing member for allowing the sound to transmit through the first gap and into the housing, the absorbing member including a number of apertures formed therein for allowing the sound to transmit through the apertures of the absorbing member and into the housing, and a silencer engaged into the absorbing member and attached to the absorbing member and including a second gap formed between the silencer and the absorbing member for allowing the sound to transmit through the second gap and into the housing, the silencer including a number of holes formed therein for allowing the sound to transmit through the holes of the silencer and into the housing. It is preferable that the silencer and the absorbing member may be selectively or changeably attached to the hood or may be easily and quickly replaced or changed with the other ones or new or different ones according to the requirement of the environment.

The hood includes at least one catch extended inwardly for engaging with and for securing the absorbing member to the hood. The hood includes a ring member having the catch extended from the ring member. The hood includes an outer member and an inner member, and the ring member is provided between the outer member and the inner member.

The inner member of the hood includes an open bottom portion. The outer member of the hood is frustum-shaped. The inner member of the hood is cylindrical.

The absorbing member includes a recess formed in an outer peripheral portion thereof for engaging with the catch of the hood and for detachably securing the absorbing member to the hood. The absorbing member includes a ring member having the recess formed in the ring member.

The absorbing member includes an outer segment and an inner segment, and the ring member is provided between the outer segment and the inner segment. The inner segment of the absorbing member includes a conical bottom member extended upwardly into the inner segment. The outer segment of the absorbing member is frustum-shaped. The inner segment of the absorbing member is cylindrical.

The absorbing member includes an inner peripheral shoulder formed in an intermediate ring member for engaging with a lower element of the silencer and for detachably retaining the silencer to the absorbing member.

The absorbing member includes an inner peripheral groove formed therein, and the silencer includes a peripheral protrusion extended therefrom for engaging with the inner peripheral groove of the absorbing member and for detachably retaining the silencer to the absorbing member.

The silencer includes an outer cap having a number of the holes formed therein. The outer cap of the silencer includes a spherical shape. The outer cap of the silencer is extended out of the absorbing member.

The housing includes at least one lock notch formed therein, and the hood includes at least one latch extended therefrom for engaging with the lock notch of the housing and for detachably securing the hood to the housing.

The housing includes at least one coupler extended out of the outer peripheral wall of the housing, and the coupler includes a bore and a slot formed therein and communicating with each other for allowing the coupler and the housing to be selectively coupled to the other coupling or supporting members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
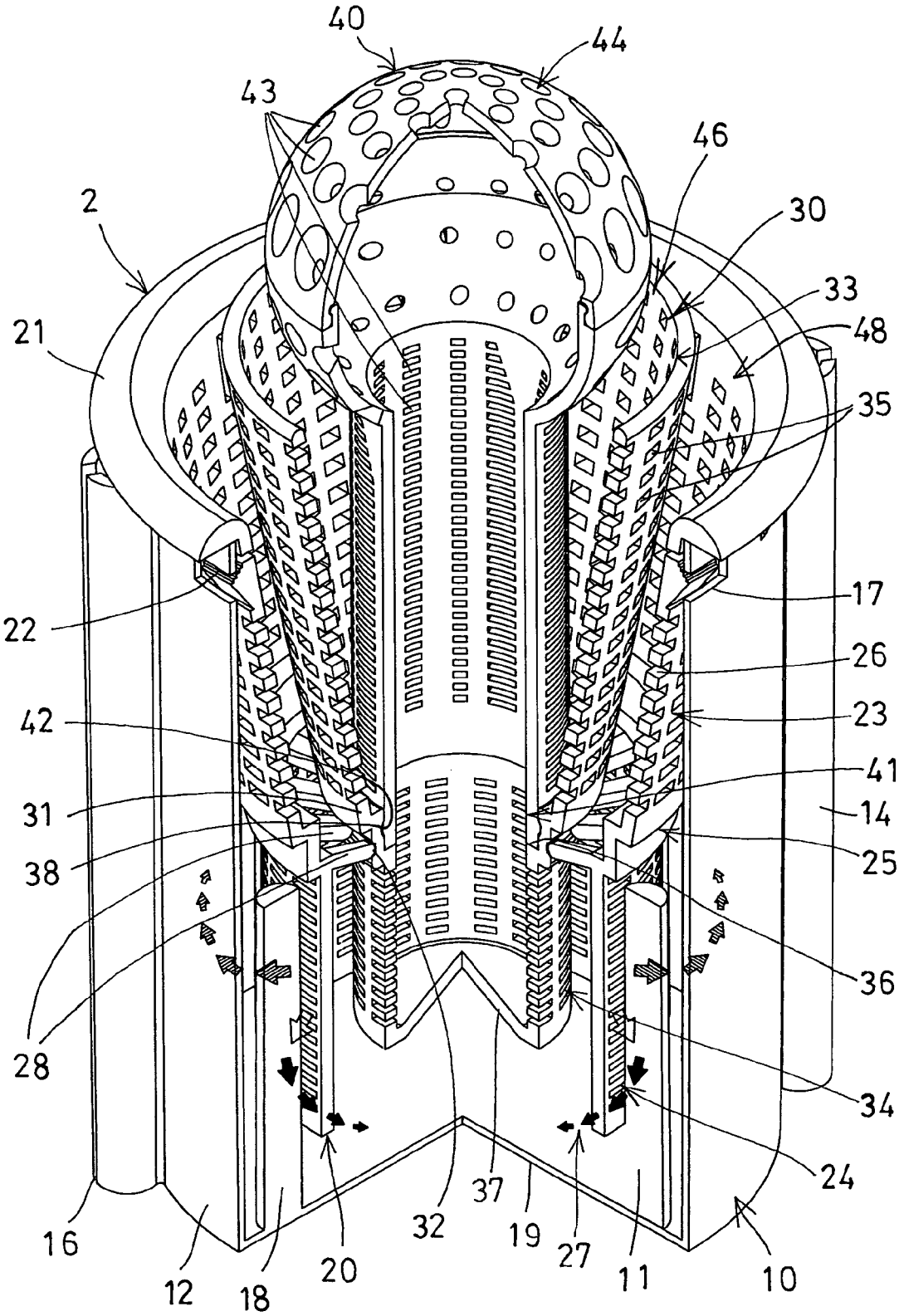
FIG. 1 is a perspective view of an acoustic absorbing device in accordance with the present invention, in which a portion of the acoustic absorbing device has been cut off for showing the inner structure of the acoustic absorbing device.
Figure 2:
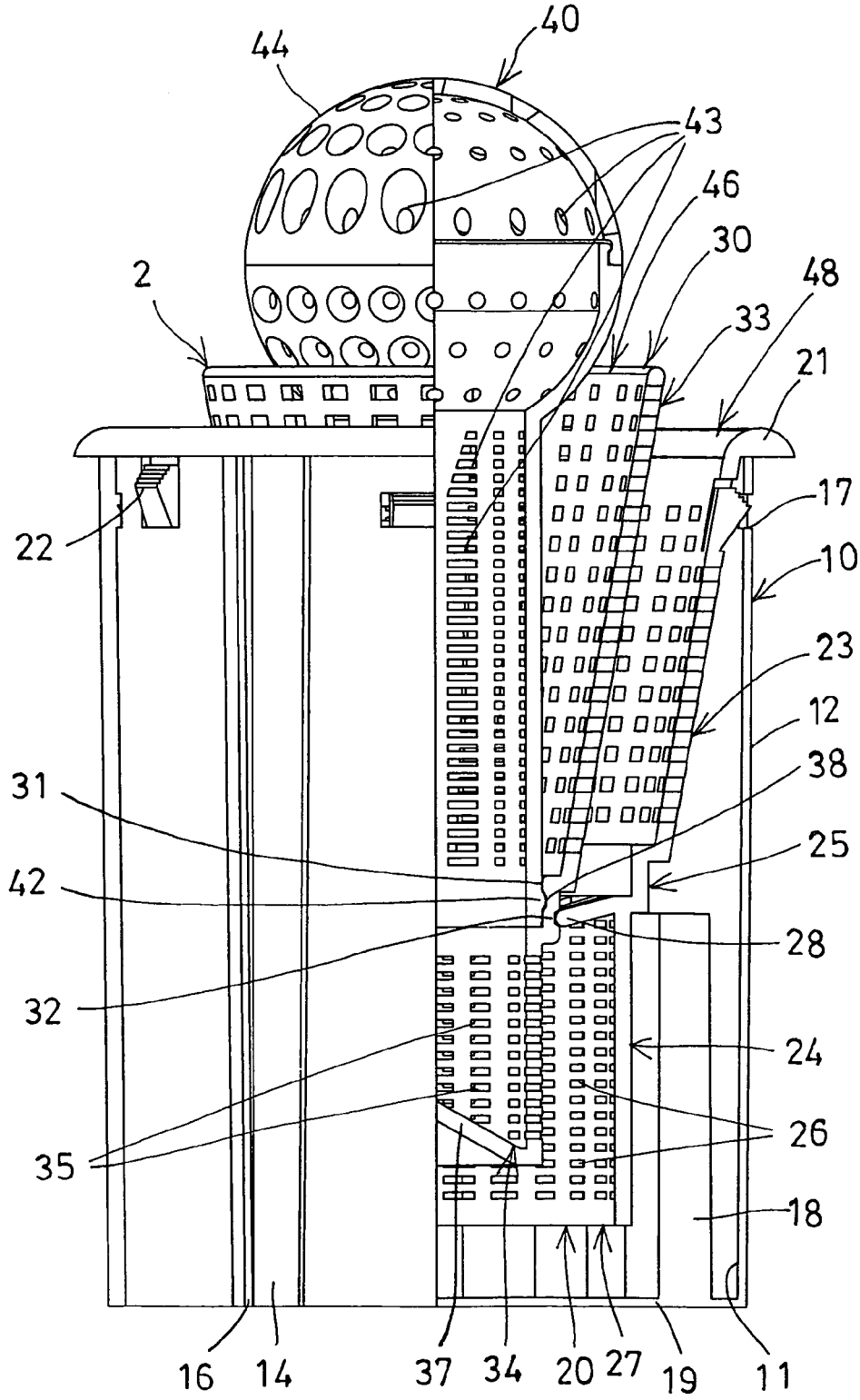
FIG. 2 is a plan schematic view of the acoustic absorbing device in which a portion of the acoustic absorbing device has also been cut off for showing the inner structure of the acoustic absorbing device.
Figure 3:
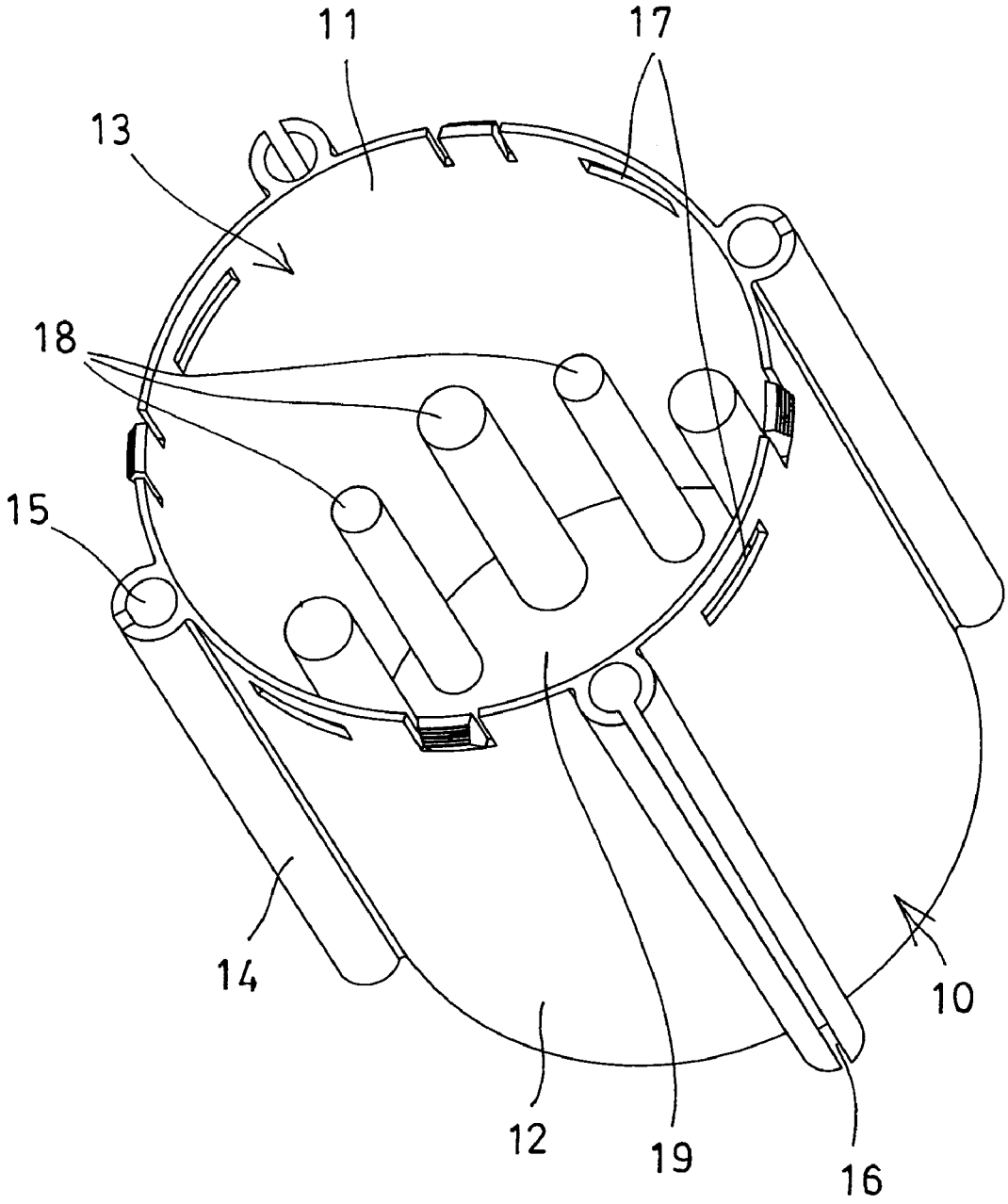
FIG. 3 is a perspective view of an outer housing of the acoustic absorbing device in a reduced size or dimension.

Referring to the drawings, and initially to FIGS. 1-3, an acoustic absorbing device in accordance with the present invention comprises an outer housing 10 including a chamber 11 formed therein and defined by an outer peripheral wall 12 and a bottom wall 19, or the outer housing 10 includes an outer peripheral wall 12 and a bottom wall 19 for forming or defining the chamber 11 thereof, and includes an outer opening end 13 (FIG. 3), and includes one or more (such as four) posts or couplers 14 extended out of the outer peripheral wall 12 of the outer housing 10 and each having a bore 15 formed therein and a slot 16 formed therein and communicating with the bore 15 thereof for coupling the outer housing 10 to the other coupling or supporting members (not shown).

The chamber 11 of the outer housing 10 may be provided for receiving an acoustic absorbing facility 2 therein, and the outer housing 10 further includes one or more (such as four) lock notches 17 formed therein, such as located at the outer opening end 13 thereof and formed in the outer peripheral wall 12 for anchoring or locking or latching the acoustic absorbing facility 2 to the outer housing 10, and the outer housing 10 further includes one or more rods or columns 18 extended into the chamber 11 of the outer housing 10 and such as extended from the bottom wall 19 of the outer housing 10 for further interfering the sound or noise entered or transmitted into the chamber 11 of the outer housing 10 and for further absorbing the sound or noise.

The acoustic absorbing facility 2 includes an outer peripheral hood 20 engaged into the chamber 11 of the outer housing 10 from the outer opening end 13 of the outer housing 10, and includes an outer peripheral flange 21 extended radially and outwardly from the upper or outer portion of the hood 20 for engaging with the outer peripheral wall 12 and for anchoring or locking or latching or positioning the hood 20 of the acoustic absorbing facility 2 to the outer housing 10, and the hood 20 includes one or more (such as four) locks or latches 22 extended outwardly therefrom for engaging with the lock notches 17 of the outer housing 10 and for detachably fixing or locking or latching or securing the hood 20 to the outer housing 10.

The hood 20 includes a conical or frustum-shaped outer member 23 and a cylindrical inner member 24 and a stepped intermediate ring member 25 formed or provided between the frustum-shaped outer member 23 and the cylindrical inner member 24, and includes a number of perforations or orifices 26 formed therein, such as formed in either or both of the outer member 23 and the inner member 24 for allowing the sound or noise to enter or transmit or spread through the orifices 26 of the hood 20 and to enter into the chamber 11 of the outer housing 10. It is preferable that the hood 20 includes an open bottom portion 27 (FIG. 1) for allowing the sound or noise to also enter into the chamber 11 of the outer housing 10 via the open bottom portion 27 of the hood 20.

The hood 20 includes one or more spring catches 28 extended radially and inwardly from the intermediate ring member 25 of the hood 20 for attaching or securing an intermediate absorbing member 30. The intermediate absorbing member 30 also includes a stepped intermediate ring member 31 formed or provided between a conical or frustum-shaped outer segment 33 and a cylindrical inner segment 34, and an outer peripheral recess 32 formed in the outer peripheral portion of the intermediate ring member 31 for engaging with the spring catches 28 of the hood 20 and for detachably fixing or locking or latching or securing the intermediate absorbing member 30 to the hood 20, and for allowing the intermediate absorbing member 30 to be replaced or changed with the other ones or new or different ones.

The intermediate absorbing member 30 also includes a number of perforations or apertures 35 formed therein, such as formed in either or both of the outer segment 33 and the inner segment 34 for allowing the sound or noise to enter or transmit or spread through the apertures 35 of the intermediate absorbing member 30 and to enter into the chamber 11 of the outer housing 10. The intermediate absorbing member 30 further includes an inner peripheral shoulder 36 formed in the intermediate ring member 31, and an inner peripheral groove 38 also formed in the intermediate ring member 31, and a conical bottom member 37 formed or provided in the lower or bottom portion of the inner segment 34 or the intermediate absorbing member 30 and extended upwardly into the inner segment 34 for guiding or deflecting the sound or noise.

The acoustic absorbing facility 2 further includes a further absorbing member or silencer 40 having a cylindrical lower portion or element 41 received or engaged in the outer segment 33 of the intermediate absorbing member 30 and having an outer peripheral protrusion 42 extended radially and outwardly from the lower element 41 of the silencer 40 for engaging with the inner peripheral groove 38 of the intermediate ring member 31 of the intermediate absorbing member 30 and for detachably fixing or locking or latching or securing the silencer 40 to the intermediate absorbing member 30, and for allowing the silencer 40 to be replaced or changed with the other ones or new or different ones.

The silencer 40 also includes a number of perforations or holes 43 formed therein, such as formed in either or both of the cylindrical element 41 and an outer spherical cap 44 for allowing the sound or noise to enter through the holes 43 of either or both of the outer cap 44 and the cylindrical element 41 and to enter into the chamber 11 of the outer housing 10. The outer cap 44 of the silencer 40 may be extended outwardly of the outer housing 10 and/or the outer segment 33 of the intermediate absorbing member 30 (FIGS. 1, 2), or may be selectively extended inwardly of the outer housing 10 and/or the outer segment 33 of the intermediate absorbing member 30 (FIGS. 4, 5), or the silencers 40 having different outer caps 44 may be replaced or changed with one another.

As shown in FIGS. 1 and 2, the silencer 40 is spaced away from the outer segment 33 of the intermediate absorbing member 30 for forming a space or gap 46 between the silencer 40 and the outer segment 33 of the intermediate absorbing member 30, and the outer segment 33 of the intermediate absorbing member 30 is also spaced away from the outer member 23 of the hood 20 for forming another space or gap 48 between the outer segment 33 of the intermediate absorbing member 30 and the outer member 23 of the hood 20, and thus for allowing the sound or noise to enter through the gaps 46, 48 of the acoustic absorbing facility 2 and to enter into the chamber 11 of the outer housing 10.

In operation, as shown in FIG. 1, the sound or noise may enter through the holes 43 of either or both of the outer cap 44 and the cylindrical element 41, and/or through the apertures 35 of the intermediate absorbing member 30, and/or through the orifices 26 of the hood 20 and may then enter into the chamber 11 of the outer housing 10, the sound or noise will then be confined within the chamber 11 of the outer housing 10, and will be restrained by the outer peripheral wall 12 of the outer housing 10, and will be interfered by the columns 18, and will then be offset or dissipated and thus will be isolated and absorbed by the acoustic absorbing facility 2.

It is to be noted that the silencer 40 and the intermediate absorbing member 30 may be easily and quickly replaced or changed with the other ones or new or different ones according to the requirement of the environment. For example, when the acoustic absorbing device in accordance with the present invention is going to be disposed on the side portions of the roadways, bridges, or the like where great noises will be generated, it is preferable that both the silencer 40 and the intermediate absorbing member 30 are provided and disposed in the hood 20 for effectively isolating or absorbing the sounds or noises. Either or both of the silencer 40 and the intermediate absorbing member 30 may be removed from the hood 20 when the acoustic absorbing device is going to be disposed in such as the house buildings where having less noise.

It is further to be noted that the silencer 40 and the intermediate absorbing member 30 may further be selectively disposed in and solidly secured to the hood 20 with such as welding processes, adhesive materials, or the like, for preventing the silencer 40 and the intermediate absorbing member 30 from being disengaged from the hood 20. As shown in FIGS. 1 and 2, the cap 44 of the silencer 40 may include a spherical shape and may be extended outwardly of the outer housing 10 and/or the outer segment 33 of the intermediate absorbing member 30 for effectively isolating or absorbing the sounds or noises.

Figure 4:
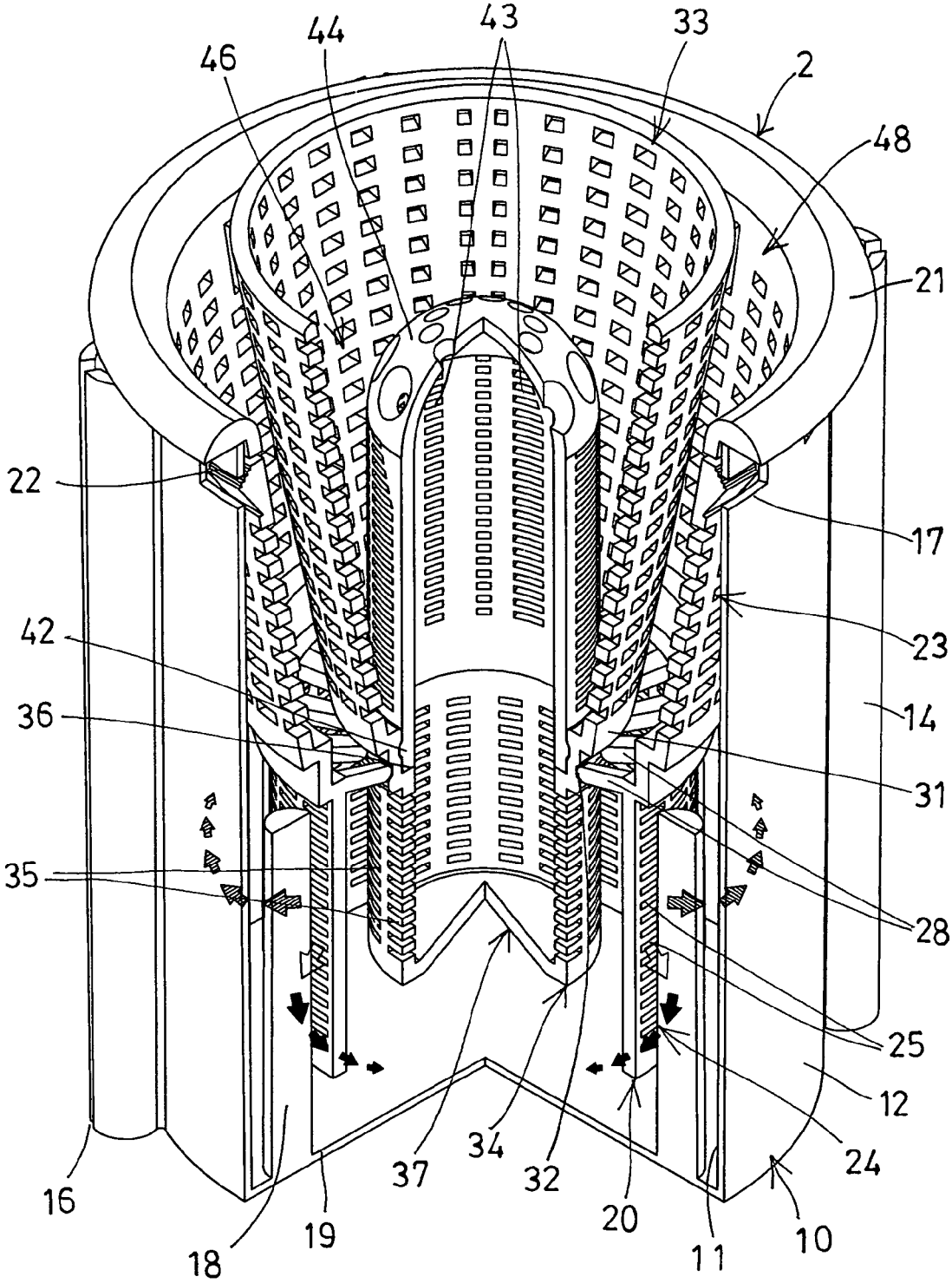
FIG. 4 is a perspective view similar to FIG. 1 illustrating the other arrangement of the acoustic absorbing device.
Figure 5:
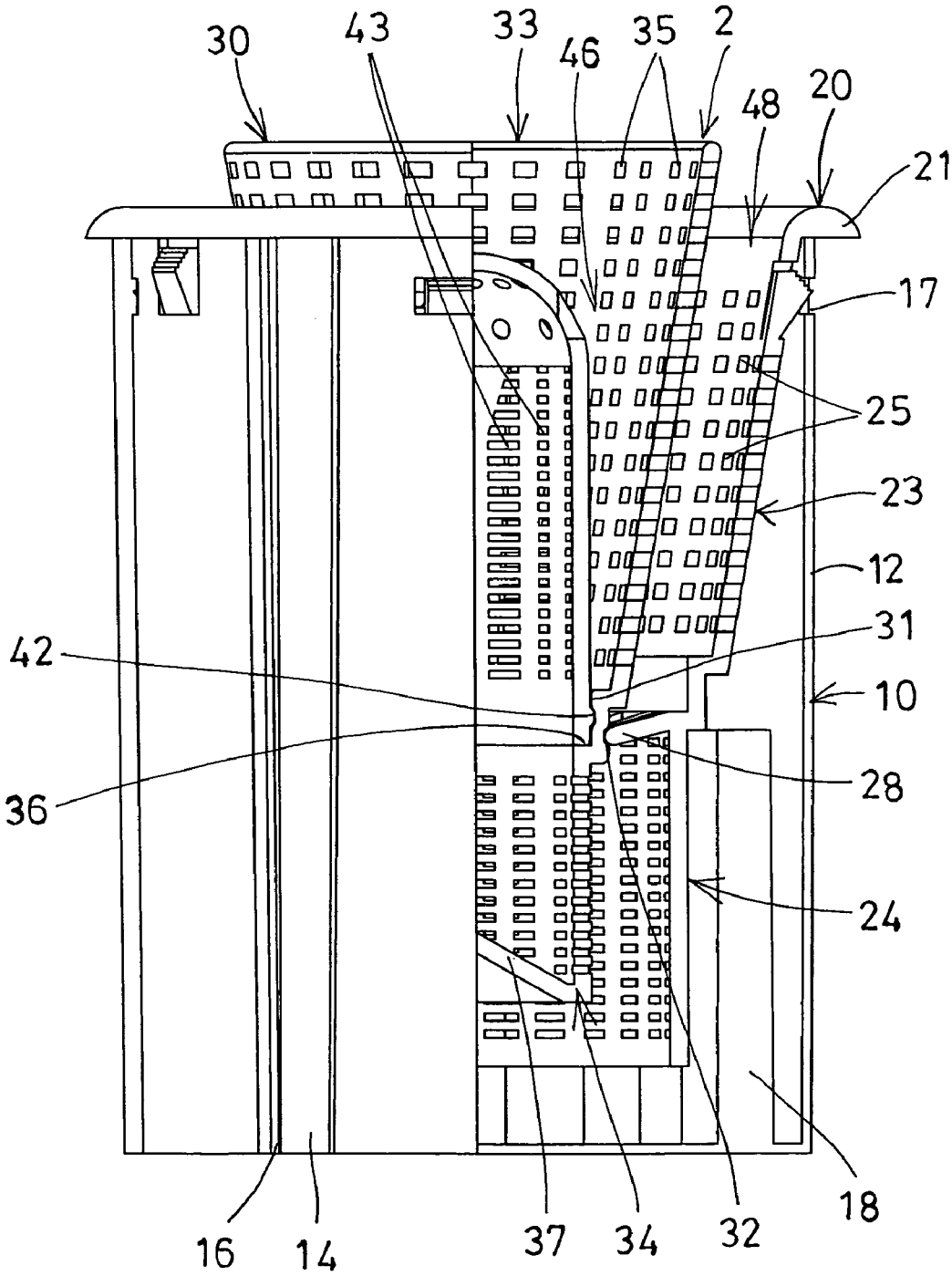
FIG. 5 is a plan schematic view of the acoustic absorbing device as shown in FIG. 4, in which a portion of the acoustic absorbing device has also been cut off for showing the inner structure of the acoustic absorbing device.

Alternatively, as shown in FIGS. 4 and 5, the silencer 40 may also include a semi-spherical shape and may be selectively extended inwardly of the outer housing 10 and/or the outer segment 33 of the intermediate absorbing member 30. It is further to be noted that the orifices 26 of the hood 20 and the apertures 35 of the intermediate absorbing member 30 and the holes 43 of the silencer 40 may be formed into various shapes or configurations, such as circular, square, rectangular, oblong, triangular, or other shapes.

Accordingly, the acoustic absorbing device in accordance with the present invention includes an improved structure for effectively absorbing sounds or noises and for allowing the acoustic absorbing device to be easily and quickly secured or attached to various support members or devices.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An acoustic absorbing device comprising:

a housing including a chamber formed therein, and including an outer peripheral wall and a bottom wall for forming said chamber of said housing, and including an outer opening end, a hood engaged into said chamber of said housing and including a plurality of orifices formed therein for allowing a sound to transmit through said hood and into said housing, an absorbing member engaged into said hood and attached to said hood and including a first gap formed between said hood and said absorbing member for allowing the sound to transmit through said first gap and into said housing, said absorbing member including a plurality of apertures formed therein for allowing the sound to transmit through said apertures of said absorbing member and into said housing, and a silencer engaged into said absorbing member and attached to said absorbing member and including a second gap formed between said silencer and said absorbing member for allowing the sound to transmit through said second gap and into said housing, said silencer including a plurality of holes formed therein for allowing the sound to transmit through said holes of said silencer and into said housing.

2. The acoustic absorbing device as claimed in claim 1, wherein said hood includes at least one catch extended inwardly for engaging with and for securing said absorbing member to said hood.

3. The acoustic absorbing device as claimed in claim 2, wherein said hood includes a ring member having said at least one catch extended from said ring member.

4. The acoustic absorbing device as claimed in claim 3, wherein said hood includes an outer member and an inner member, and said ring member is provided between said outer member and said inner member.

5. The acoustic absorbing device as claimed in claim 4, wherein said inner member of said hood includes an open bottom portion.

6. The acoustic absorbing device as claimed in claim 4, wherein said outer member of said hood is frustum-shaped.

7. The acoustic absorbing device as claimed in claim 4, wherein said inner member of said hood is cylindrical.

8. The acoustic absorbing device as claimed in claim 2, wherein said absorbing member includes a recess formed in an outer peripheral portion thereof for engaging with said at least one catch of said hood and for detachably securing said absorbing member to said hood.

9. The acoustic absorbing device as claimed in claim 8, wherein said absorbing member includes a ring member having said recess formed in said ring member.

10. The acoustic absorbing device as claimed in claim 9, wherein said absorbing member includes an outer segment and an inner segment, and said ring member is provided between said outer segment and said inner segment.

11. The acoustic absorbing device as claimed in claim 10, wherein said inner segment of said absorbing member includes a conical bottom member extended upwardly into said inner segment.

12. The acoustic absorbing device as claimed in claim 10, wherein said outer segment of said absorbing member is frustum-shaped.

13. The acoustic absorbing device as claimed in claim 10, wherein said inner segment of said absorbing member is cylindrical.

14. The acoustic absorbing device as claimed in claim 1, wherein said absorbing member includes an inner peripheral shoulder formed in an intermediate ring member for engaging with a lower element of said silencer and for detachably retaining said silencer to said absorbing member.

15. The acoustic absorbing device as claimed in claim 1, wherein said absorbing member includes an inner peripheral groove formed therein, and said silencer includes a peripheral protrusion extended therefrom for engaging with said inner peripheral groove of said absorbing member and for detachably retaining said silencer to said absorbing member.

16. The acoustic absorbing device as claimed in claim 1, wherein said silencer includes an outer cap having a plurality of said holes formed therein.

17. The acoustic absorbing device as claimed in claim 16, wherein said outer cap of said silencer includes a spherical shape.

18. The acoustic absorbing device as claimed in claim 16, wherein said outer cap of said silencer is extended out of said absorbing member.

19. The acoustic absorbing device as claimed in claim 1, wherein said housing includes at least one lock notch formed therein, and said hood includes at least one latch extended therefrom for engaging with said at least one lock notch of said housing and for detachably securing said hood to said housing.

20. The acoustic absorbing device as claimed in claim 1, wherein said housing includes at least one coupler extended out of said outer peripheral wall of said housing, and said at least one coupler includes a bore and a slot formed therein and communicating with each other.

* * * * *